US007954870B2

(12) United States Patent
Chen

(10) Patent No.: US 7,954,870 B2
(45) Date of Patent: Jun. 7, 2011

(54) TWEEZERS WITH MAGNETICALLY PIVOTAL ILLUMINATION DEVICE

(76) Inventor: Ming-Nan Chen, Taichung (TW)

( * ) Notice: Subject to any disclaimer, the term of this patent is extended or adjusted under 35 U.S.C. 154(b) by 140 days.

(21) Appl. No.: 12/453,794

(22) Filed: May 22, 2009

(65) Prior Publication Data

US 2010/0295326 A1 Nov. 25, 2010

(51) Int. Cl.
*B25B 7/00* (2006.01)

(52) U.S. Cl. ..... 294/99.2; 362/119

(58) Field of Classification Search ..... 294/3, 99.2; 362/119; 606/211
See application file for complete search history.

(56) References Cited

U.S. PATENT DOCUMENTS 2,376,448 A * 5/1945 Neugass ..... 606/211
D171,264 S * 1/1954 Peterson et al. ..... D28/55
2,666,843 A * 1/1954 Zuckerman ..... 362/120
3,287,547 A * 11/1966 Spedding ..... 362/119
6,974,226 B2 * 12/2005 Chang ..... 362/103
7,108,395 B2 * 9/2006 Correa ..... 362/191
7,201,479 B2 * 4/2007 Spitzer ..... 351/158
D544,647 S * 6/2007 Israel ..... D28/55

* cited by examiner

*Primary Examiner* — Saúl J Rodríguez
*Assistant Examiner* — Stephen Vu
(74) *Attorney, Agent, or Firm* — Bacon & Thomas, PLLC

(57) ABSTRACT

A tweezers includes two joined metal legs comprising a forward gripping end and a force exertion portion extending from a rear end of the leg to the gripping end wherein a projection is formed on an inner surface of a head part joining the legs; a battery powered light source having a forward portion pivotably secured to the legs and comprising an on/off switch; a magnet disposed in a rear end of the light source and adapted to attach to the projection; and a plastic member covered the head part and the force exertion portions of the legs. An angle of light emitted from the light source can be adjusted to illuminate an area being worked therewith.

4 Claims, 5 Drawing Sheets

TWEEZERS WITH MAGNETICALLY PIVOTAL ILLUMINATION DEVICE

BACKGROUND OF THE INVENTION

1. Field of Invention

The invention relates to tweezers and more particularly to such a tweezers having a magnetically pivotal illumination device so that an angle of emitted light can be adjusted to illuminate an area being worked therewith.

2. Description of Related Art

Tweezers are used for a wide variety of applications. For example, they can be used to remove splinters embedded in one's skin. They are also used in certain repair work, model building, stamp collecting and other endeavors involving the handling of small objects. Tweezers are also used to precisely handle small articles. For example, in watch repair tweezers are needed to handle and position the small parts for assembly work. In each application, the object being handled is generally quite small making visibility an inherent problem.

A conventional tweezers is shown in FIG. 1. One drawback of the conventional tweezers is that an additional illumination device (i.e., light source) is required if a user wants to use the tweezers to illuminate little objects in a dark environment.

Another conventional tweezers 10 as an improvement of the above tweezers is shown in FIG. 2. The tweezers 10 comprises two bent legs 13 having a gripping end 14, and a bulged head part 11 having a threaded hole with an illumination device 12 threadedly secured thereto.

While the conventional tweezers 10 fulfills its respective, particular objective, it still has the following drawbacks. The threaded fastening of the illumination device 12 may be loosened as time evolves. Further, an angle of light emitted from a light source of the illumination device 12 cannot be adjusted due to it is affixed thereto. This may be inconvenient in some applications. No padding or comfortable covering is provided on portions of the legs 13 proximate the head part 11 (i.e., portions to be held by the hand). Hence, a user may feel a degree of discomfort if he/she holds the tweezers 10 to handle little objects (i.e., exerting a great force thereupon) for a prolonged period of time. This is because the tweezers 10 is made of metal. Thus, the need for improvement still exists.

SUMMARY OF THE INVENTION

It is therefore one object of the invention to provide a tweezers having a magnetically pivotal illumination device so that an angle of emitted light can be adjusted to illuminate an area being worked therewith.

The above and other objects, features and advantages of the invention will become apparent from the following detailed description taken with the accompanying drawings.

DETAILED DESCRIPTION OF THE INVENTION

Figure 1:
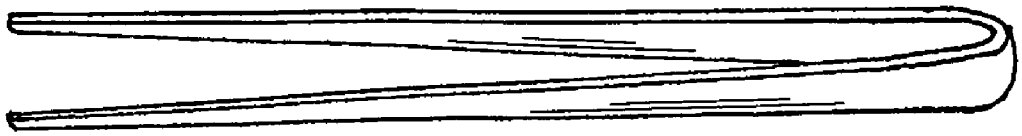
Fig. 1 PRIOR ART
FIG. 1 is a perspective view of a conventional tweezers.
Figure 2:
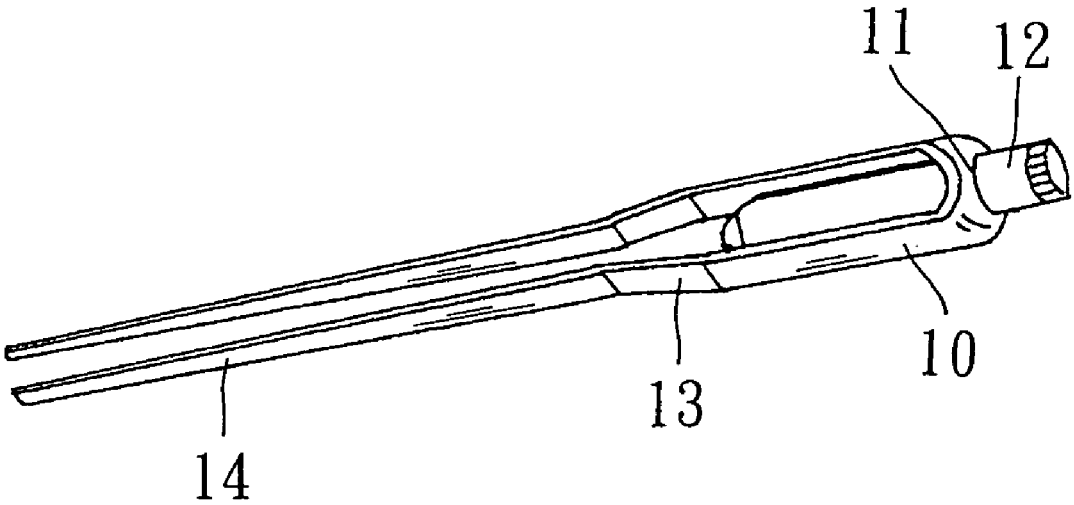
Fig. 2 PRIOR ART
FIG. 2 is a perspective view of another conventional tweezers having an illumination device.
Figure 3:
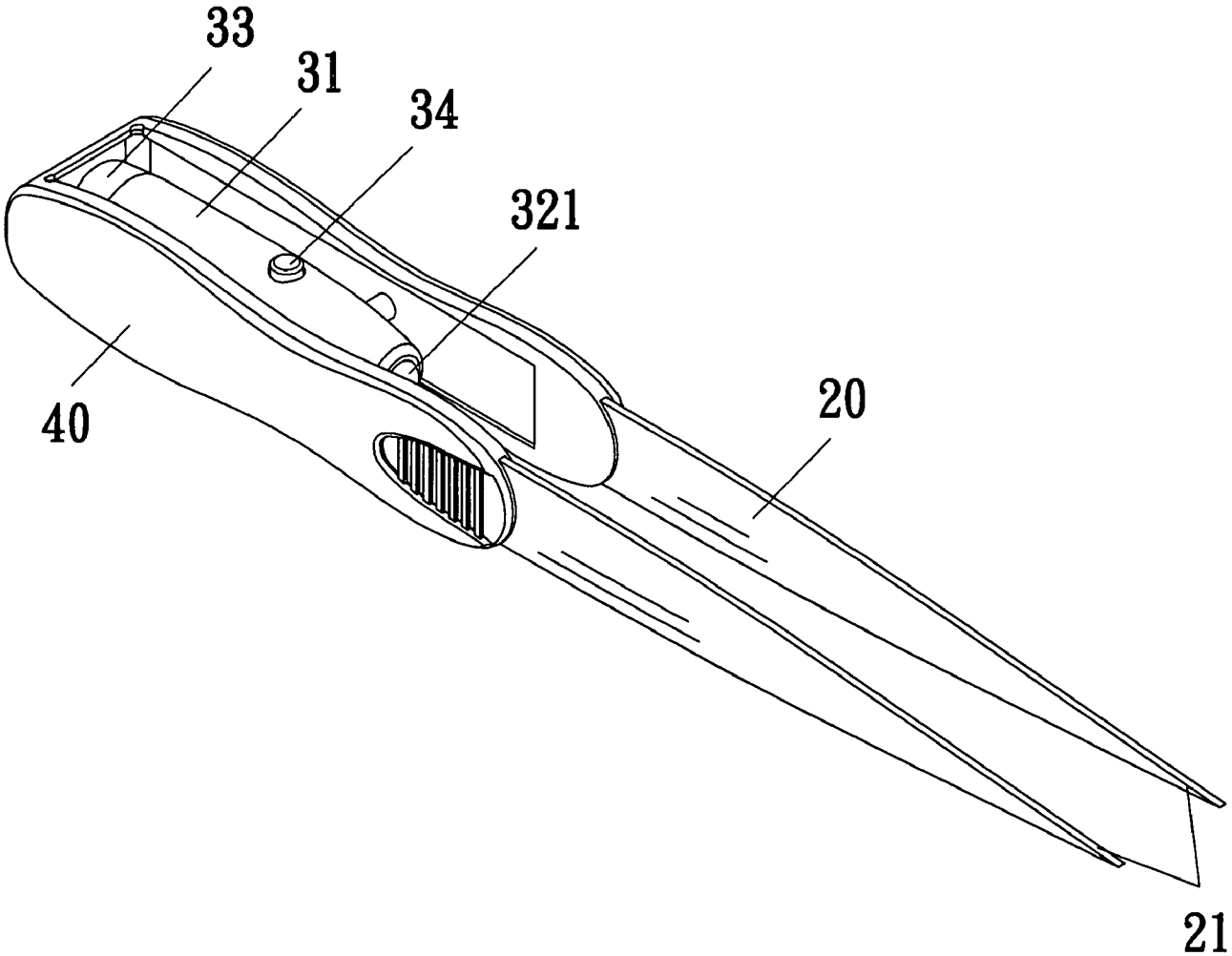
FIG. 3 is a perspective view of a first preferred embodiment of tweezers according to the invention where gripping ends thereof are straight.
Figure 4:
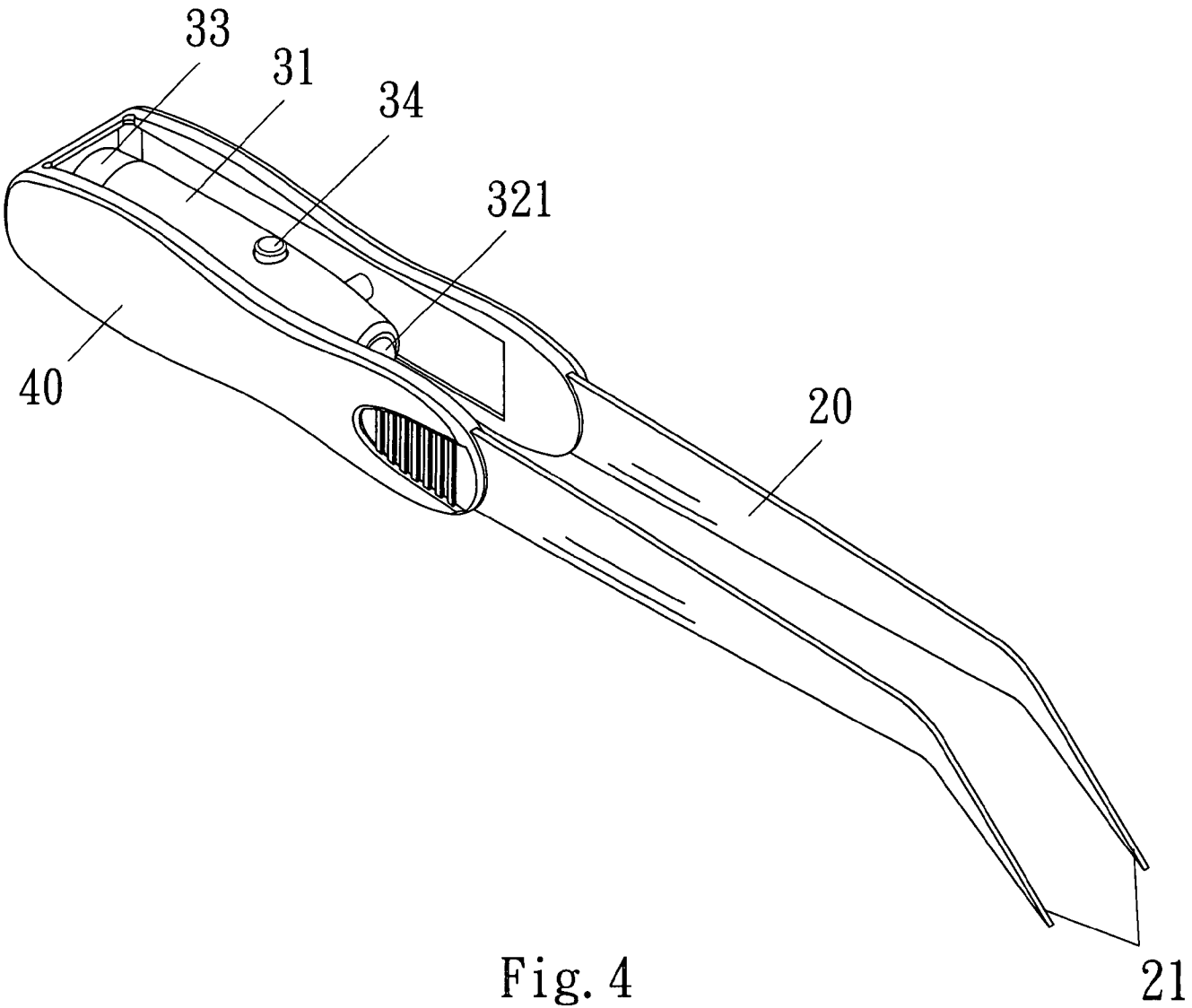
FIG. 4 is a perspective view of a second preferred embodiment of tweezers according to the invention where gripping ends thereof are oblique.
Figure 5:
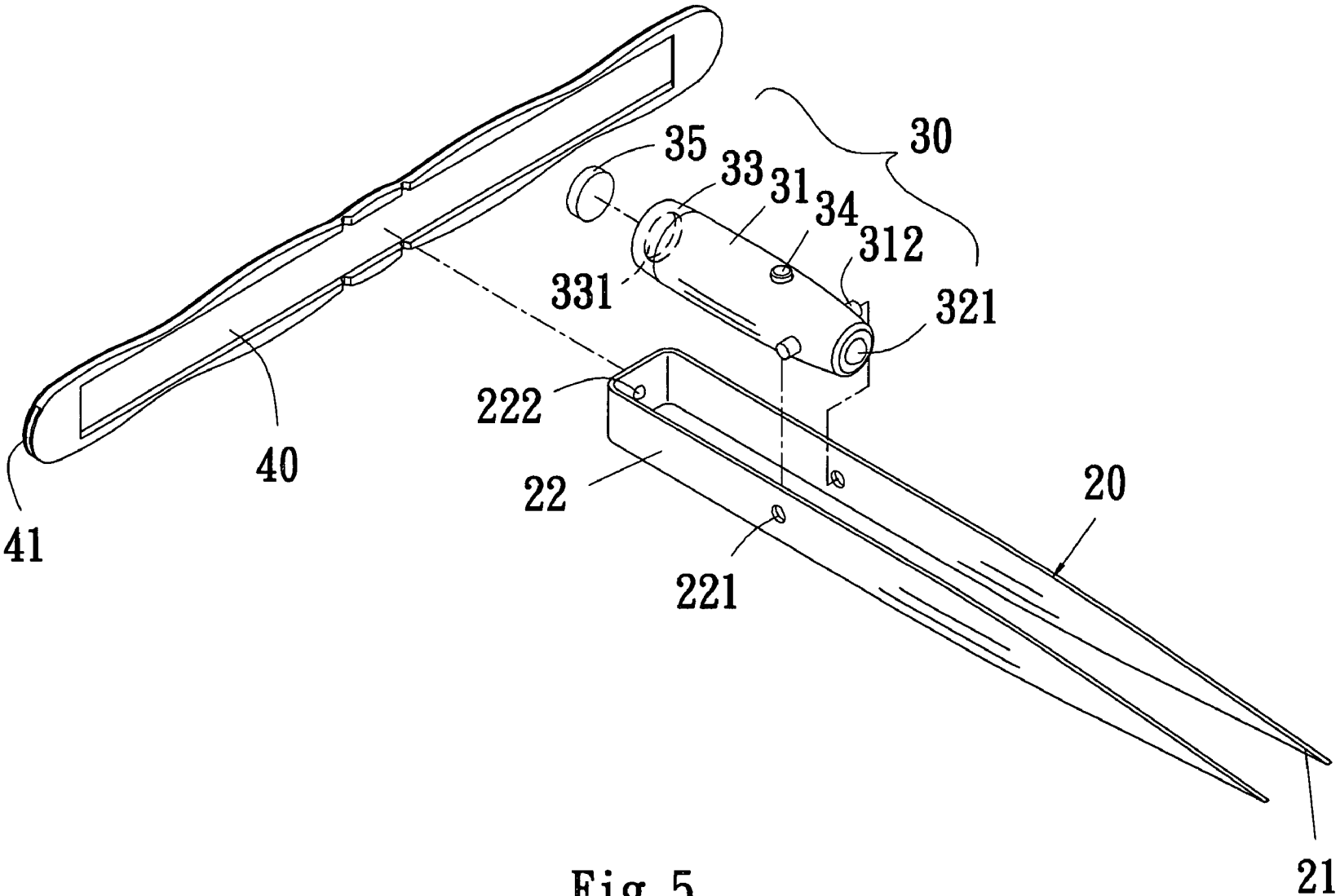
FIG. 5 is an exploded view of the first preferred embodiment of tweezers.
Figure 7:
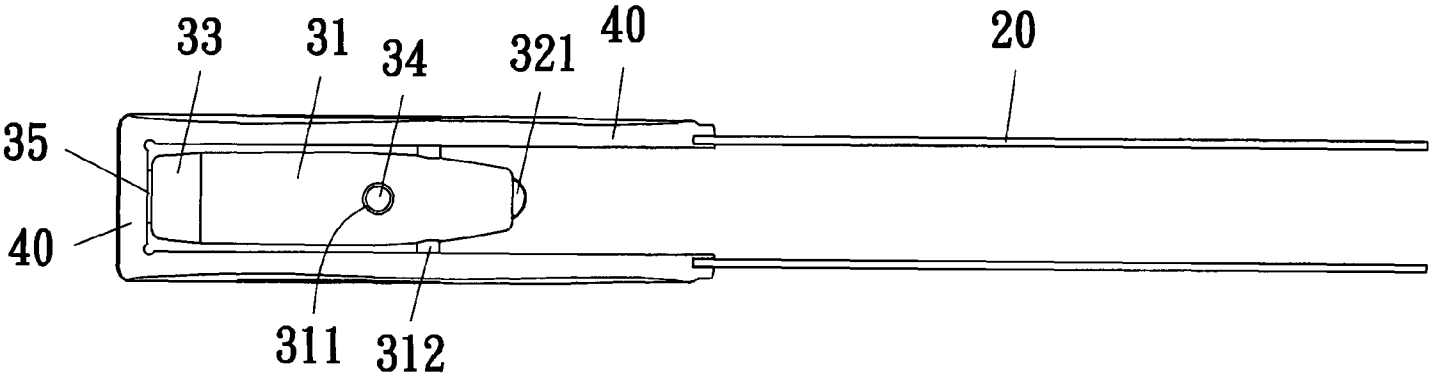
FIG. 7 is a top plan view of the tweezers shown in FIG. 3.
Figure 6:
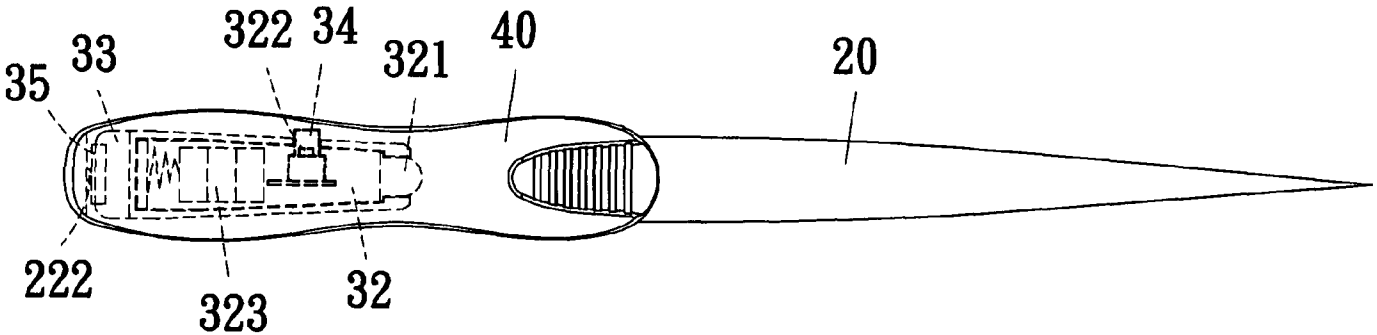
FIG. 6 is a side elevation of the tweezers shown in FIG. 3.

Referring to FIGS. 3 to 7, a tweezers in accordance with the invention is shown. The tweezers comprises the following components as discussed in detail below.

Two legs 20 each has a straight gripping end 21 according to a first preferred embodiment of the invention as shown of FIGS. 3, 5, 6, and 7. Alternatively, the legs 20 each may have an oblique gripping end 21 according to a second preferred embodiment of the invention as shown of FIG. 4. The legs 20 are made of metal. The leg 20 further has a distal end (i.e., force exertion end) 22 opposite the proximal gripping end 21. The distal end 22 has a hole 221. Moreover, a substantially half-spherical projection 222 is formed on an inner surface of a stationary head part joining the legs 22.

An illumination device 30 comprises a substantially cylindrical casing 31 including a top aperture 311 and two lateral pins 312 proximate a forward end thereof, the pins 312 being somewhat loosely inserted into the holes 221 so that the illumination device 3 may pivot about the legs 22; and a light source 32 including a bulb 321 projecting out of the forward end of the casing 31, a hidden on/off switch 322 disposed in the aperture 311, and a series of cells 323 electrically connected in series and provided in a battery compartment (not numbered). The components of the light source 32 are electrically connected together.

The illumination device 30 further comprises a rear socket 33 including a short cylindrical cavity 331 open to a rear end of the casing 31; a magnet (e.g., a permanent magnet) 35 anchored in the cavity 331 and attached to a metal member (not shown) in the projection 222; and a depressible member 34 covering the switch 322.

A substantially elongated, rectangular covering 40 is formed to cover the distal ends (i.e., force exertion ends) 22 of the legs 22 and the stationary head part joining the legs 22 by injection molding. The covering 40 includes a pair of openings 41 at its ends for receiving the legs 20. The plastic covering 40 is provided to increase a degree of comfort of the hand holding the tweezers in use.

It is envisaged by the invention that in an operation of the tweezers a user may, after turning on the illumination device 30 by pressing the depressible member 34 to activate the switch 322, adjust a contact point of the magnet 35 and the projection 222 by further pivoting the casing 31 about the pins 312 an optimum small angle. As an end, light emitted from the bulb 321 may completely illuminate an area being worked therewith.

While the invention herein disclosed has been described by means of specific embodiments, numerous modifications and variations could be made thereto by those skilled in the art without departing from the scope and spirit of the invention set forth in the claims.

What is claimed is:

1. A pair of tweezers comprising:

two joined metal legs each comprising a forward gripping end and a force exertion portion extending from a rear end of each of the legs to the gripping end, wherein a projection is formed on an inner surface of a head part which joins the legs;

a battery powered light source having a forward portion pivotably secured directly to the legs and comprising a switch mounted thereon;

a magnet disposed in a rear end of the light source and adapted to attach to the projection; and a plastic member covering the head part and the force exertion portions of the legs.

2. The pair of tweezers of claim 1, wherein the gripping ends are straight.

3. The pair of tweezers of claim 1, wherein the gripping ends are oblique.

4. The pair of tweezers of claim 1, wherein the magnet is a permanent magnet.

* * * * *